US005853635A

United States Patent [19]

Morell et al.

[11] Patent Number: 5,853,635

[45] Date of Patent: Dec. 29, 1998

[54] METHOD OF MAKING HETEROCONSTITUENT AND LAYERED NONWOVEN MATERIALS

[75] Inventors: Charles J. Morell; Bryan D. Haynes, both of Roswell, Ga.

[73] Assignee: Kimberly-Clark Worldwide, Inc., Neenah, Wis.

[21] Appl. No.: 878,288

[22] Filed: Jun. 18, 1997

Related U.S. Application Data

[60] Provisional application No. 60/034,392 Dec. 30, 1996.

[51] Int. Cl. [6] ..... D04H 1/56; D04H 3/16

[52] U.S. Cl. ..... 264/103; 156/62.2; 156/167; 156/181; 264/113; 264/121; 264/168; 264/171.1; 264/172.12; 264/172.13; 264/172.14; 264/172.15; 264/177.13; 264/210.8; 264/211.14; 264/510; 264/518; 264/555

[58] Field of Search ..... 264/103, 113, 264/121, 168, 171.1, 172.12, 172.13, 172.14, 172.15, 177.13, 210.8, 211.14, 510, 518, 555; 156/62.2, 167, 181

[56] References Cited

U.S. PATENT DOCUMENTS

| | | |
|---|---|---|
| 3,272,898 | 9/1966 | Knee . |
| 3,338,992 | 8/1967 | Kinney . |
| 3,341,394 | 9/1967 | Kinney . |
| 3,459,627 | 8/1969 | Vosburgh, Sr. . |
| 3,502,538 | 3/1970 | Petersen . |
| 3,502,763 | 3/1970 | Hartmann . |
| 3,542,615 | 11/1970 | Dobo et al. . |
| 3,692,618 | 9/1972 | Dorschner et al. . |
| 3,802,817 | 4/1974 | Matsuki et al. . |
| 3,806,289 | 4/1974 | Schwarz . |
| 3,855,046 | 12/1974 | Hansen et al. . |
| 4,041,203 | 8/1977 | Brock et al. . |
| 4,089,720 | 5/1978 | Haley . |
| 4,209,563 | 6/1980 | Sisson . |
| 4,212,692 | 7/1980 | Rasen et al. . |
| 4,318,676 | 3/1982 | Gerking et al. . |
| 4,340,563 | 7/1982 | Appel et al. . |
| 4,374,888 | 2/1983 | Bornslaeger . |
| 4,430,563 | 2/1984 | Harrington . |
| 4,469,499 | 9/1984 | Lecron et al. . |
| 4,627,811 | 12/1986 | Greiser et al. . |
| 4,738,607 | 4/1988 | Nakajima et al. . |
| 4,783,231 | 11/1988 | Raley . |
| 4,818,464 | 4/1989 | Lau ..... 264/510 |
| 4,846,653 | 7/1989 | Beck et al. . |
| 4,997,611 | 3/1991 | Hartmann . |
| 5,108,820 | 4/1992 | Kaneko et al. . |
| 5,108,827 | 4/1992 | Gessner . |
| 5,169,706 | 12/1992 | Collier, IV et al. . |
| 5,178,931 | 1/1993 | Perkins et al. . |
| 5,336,552 | 8/1994 | Strack et al. . |
| 5,344,297 | 9/1994 | Hills . |
| 5,352,106 | 10/1994 | Lenk et al. . |
| 5,382,400 | 1/1995 | Pike et al. . |
| 5,387,387 | 2/1995 | James et al. . |
| 5,511,960 | 4/1996 | Terakawa et al. . |
| 5,556,589 | 9/1996 | Sibal . |

OTHER PUBLICATIONS

*Polymer Blends and Composites,* Manson, John A. and Sperling, Leslie H.; Plenum Press, New York, Copyright 1976; ISBN 0–306–30831–2, pp. 273–277.

*Primary Examiner*—Leo B. Tentoni
*Attorney, Agent, or Firm*—Speckman Pauley Petersen & Fejer

[57] ABSTRACT

The present invention is directed to a method of forming a heteroconstituent nonwoven web including a mixture of different filament types simultaneously formed into the same web. The filament types may differ as to polymer composition, additive loadings, fiber size, fiber shape, and/or degree of crimping. The invention is also directed to a method of forming a multilayered nonwoven structure in which different filament types constituting different layers are simultaneously formed.

57 Claims, 6 Drawing Sheets

METHOD OF MAKING HETEROCONSTITUENT AND LAYERED NONWOVEN MATERIALS

This application is a continuation-in-part of U.S. Provisional patent application Ser. No. 60/034,392, filed on 30 Dec. 1996, the disclosure of which is incorporated by reference.

FIELD OF THE INVENTION

This invention is directed to heteroconstituent and layered nonwoven materials. More precisely, the invention is directed to heteroconstituent and layered spunbond materials produced using a dual or split spinpack spinning process including a dual slot fiber drawing unit with one or more banks.

BACKGROUND OF THE INVENTION

Nonwoven fabrics and their manufacture have been the subject of extensive development resulting in a wide variety of materials for numerous applications. For example, nonwovens of light basis weight and open structure are used in personal care items such as disposable diapers as liner fabrics that provide dry skin contact but readily transmit fluids to more absorbent materials which may also be nonwovens of a different composition and/or structure. Nonwovens of heavier weights may be designed with pore structures making them suitable for filtration, absorbent and barrier applications such as wrappers for items to be sterilized, wipers or protective garments for medical, veterinary or industrial uses. Even heavier weight nonwovens have been developed for recreational, agricultural and construction uses. These are but a few of the practically limitless examples of types of nonwovens and their uses that will be known to those skilled in the art who will also recognize that new nonwovens and uses are constantly being identified. There have also been developed different ways and equipment to make nonwovens having desired structures and compositions suitable for these uses. Examples of such processes include spunbonding, meltblowing, carding, and others which will be described in greater detail below. The present invention has applicability to heteroconstituent and layered materials generally of the spunbond type as will be apparent to one skilled in the art.

Spunbond processes generally require large amounts of a fluid such as air that is used for quenching the molten filaments and for drawing and attenuating the filaments for increased strength. This fluid not only represents a cost, but it must be carefully controlled to avoid deleterious effects on the filaments and the resulting nonwoven web. While many advancements have been made in spunbonding processes and equipment, improved web uniformity, strength, tactile and appearance properties with higher efficiency have been sought-after goals. These goals were addressed by the dual or split spinpack spinning process disclosed and claimed in U.S. Provisional patent application Ser. No.60/034,392, filed on 30 Dec. 1996. That Application did not address the potential for making novel heteroconstituent and layered spunbond materials made using the apparatus.

SUMMARY OF THE INVENTION

The present invention is directed to a method of making heteroconstituent and layered spunbond nonwovens. The method can use the apparatus described in U.S. Provisional patent application Ser. No. 60/034,392, the disclosure of which is incorporated herein by reference. That apparatus combines multiple spinplates into one or more banks or divides a spinplate into multiple components with a central fluid conduit. The method involves extruding different filament types from the different spinplates and combining the filaments together. A variety of biconstituent or layered spunbond materials can be produced using the dual or split spinpack spinning process with the dual slot fiber drawing unit and one or more banks.

Using dual or split spinplates with a single slot, biconstituent spunbond materials are made which incorporate mixtures of filaments with different polymer types, fiber size ranges, fiber shapes, additive loadings, crimp levels, and/or other compositional and physical properties.

With the foregoing in mind, it is a feature and advantage of the invention to provide a method of making a biconstituent nonwoven spunbond web that contains a mixture of fiber types A and B having different compositional and/or physical properties.

It is also a feature and advantage of the invention to provide a method of making a multilayered nonwoven spunbond web whose individual layers include fiber types having different compositional and/or physical properties.

It is also a feature and advantage of the invention to provide a multilayered nonwoven spunbond web prepared by the method of the invention, whose different layers include fiber types having different compositional and/or physical properties.

The foregoing and other features and advantages of the invention will become further apparent from the following detailed description of the presently preferred embodiments, read in conjunction with the accompanying examples and drawings.

DEFINITIONS

Figure 1:
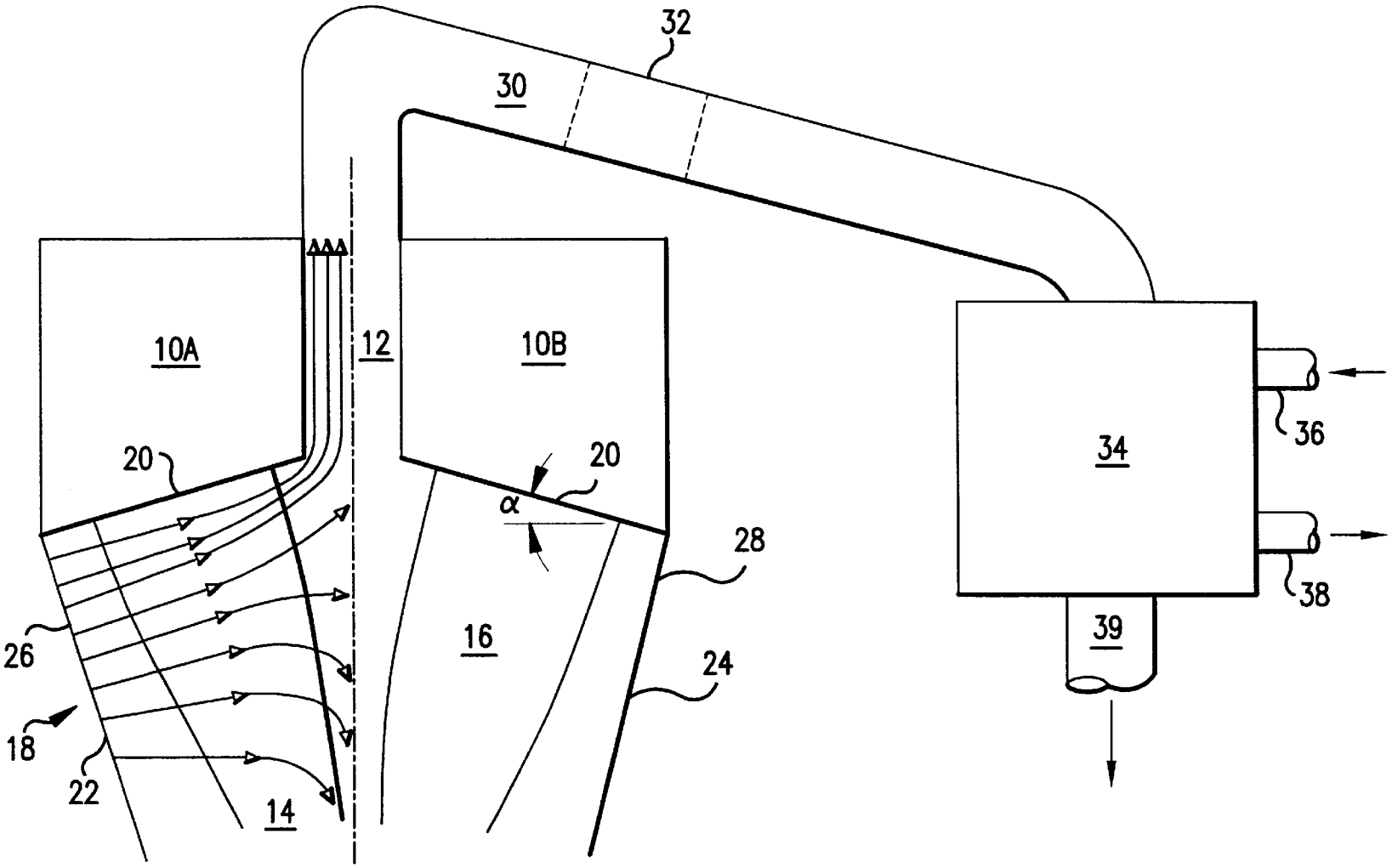
FIG. 1 is a schematic illustration of one embodiment of a multiple spinplate arrangement and process of the present invention showing a central conduit used for exhaust and means for removal of waxes and the like from the spinning process.

As used herein, the term "nonwoven fabric or web" means a web having a structure of individual fibers or threads which are interlaid, but not in a regular or identifiable manner as in a knitted fabric. Nonwoven fabrics or webs have been formed from many processes such as for example, meltblowing processes, spunbonding processes, and bonded carded web processes. The basis weight of nonwoven fabrics is usually expressed in ounces of material per square yard (osy) or grams per square meter (gsm) and the fiber diameters useful are usually expressed in microns. (Note that to convert from osy to gsm, multiply osy by 33.91).

As used herein, the term "microfibers" means small diameter fibers having an average diameter not greater than about 75 microns, for example, having an average diameter of from about 5 microns to about 50 microns, or more particularly, microfibers may have an average diameter of from about 10 microns to about 120 microns. Another frequently used expression of fiber diameter is denier, which is defined as grams per 9000 meters of a fiber and may be calculated as fiber diameter in microns squared, multiplied by the density in grams/cc, multiplied by 0.00707. A lower denier indicates a finer fiber and a higher denier indicates a thicker or heavier fiber. For example, the diameter of a polypropylene fiber given as 15 microns may be converted to denier by squaring, multiplying the result by 0.89 g/cc and multiplying by 0.00707. Thus, a 15 micron polypropylene fiber has a denier of about 1.42 ($15^2 \times 0.89 \times 0.00707 = 1.415$). Outside the United States the unit of measurement is more commonly the "tex", which is defined as the grams per kilometer of fiber. Tex may be calculated as denier/9.

As used herein, the term "spunbonded fibers" refers to small diameter fibers which are formed by extruding molten thermoplastic material as filaments from a plurality of fine, usually circular capillaries of a spinneret with the diameter of the extruded filaments then being rapidly reduced as by, for example, in U.S. Pat. No. 4,340,563 to Appel et al., and U.S. Pat. No. 3,692,618 to Dorschner et al., U.S. Pat. No. 3,802,817 to Matsuki et al., U.S. Pat. Nos. 3,338,992 and 3,341,394 to Kinney, U.S. Pat. No. 3,502,763 to Hartman, U.S. Pat. No. 3,502,538 to Levy, and U.S. Pat. No. 3,542,615 to Dobo et al., each of which is incorporated herein in its entirety by reference. Spunbond fibers are generally not tacky when they are deposited onto a collecting surface. Spunbond fibers are quenched and generally continuous and have average diameters larger than about 7 microns, more particularly, between about 10 and 20 microns.

As used herein, the term "polymer" generally includes but is not limited to, homopolymers, copolymers, such as for example, block, graft, random and alternating copolymers, terpolymers, etc. and blends and modifications thereof. Furthermore, unless otherwise specifically limited, the term "polymer" shall include all possible geometrical configurations of the material. These configurations include, but are not limited to isotactic, syndiotactic and random symmetries.

As used herein, the term "monocomponent" fiber refers to a fiber formed from one or more extruders using only one polymer. This is not meant to exclude fibers formed from one polymer to which small amounts of additives have been added for color, anti-static properties, lubrication, hydrophilicity, etc. These additives, e.g., titanium dioxide for color, are generally present in an amount less than 5 weight percent and more typically about 2 weight percent.

As used herein, the term "conjugate fibers" refers to fibers which have been formed from at least two polymers extruded from separate extruders but spun together to form one fiber. Conjugate fibers are also sometimes referred to as multicomponent or bicomponent fibers. The polymers are usually different from each other though conjugate fibers may be monocomponent fibers. The polymers are arranged in substantially constantly positioned distinct zones across the cross section of the conjugate fibers and extend continuously along the length of the conjugate fibers. The configuration of such a conjugate fiber may be, for example, a sheath/core arrangement wherein one polymer is surrounded by another or may be a side by side arrangement or an "islands-in-the-sea" arrangement. Conjugate fibers are taught in U.S. Pat. No. 5,108,820 to Kaneko et al., U.S. Pat. No. 5,336,552 to Strack et al., and U.S. Pat. No. 5,382,400 to Pike et al., each of which is incorporated herein in its entirety by reference. For two component fibers, the polymers may be present in ratios of 75/25, 50/50, 25/75 or any other desired ratios.

As used herein, the term "biconstituent fibers" refers to fibers which have been formed from at least two polymers extruded from the same extruder as a blend. The term "blend" is defined below. Biconstituent fibers do not have the various polymer components arranged in relatively constantly positioned distinct zones across the cross-sectional area of the fiber and the various polymers are usually not continuous along the entire length of the fiber, instead usually forming fibrils or protofibrils which start and end at random. Biconstituent fibers are sometimes also referred to as multiconstituent fibers. Fibers of this general type are discussed in, for example, U.S. Pat. No. 5,108,827 to Gessner. Bicomponent and biconstituent fibers are also discussed in the textbook *Polymer Blends and Composites* by John A. Manson and Leslie H. Sperling, copyright 1976 by Plenum Press, a division of Plenum Publishing Corporation of New York, IBSN 0-306-30831-2, at pages 273 through 277.

As used herein, the term "blend" as applied to polymers, means a mixture of two or more polymers while the term "alloy" means a sub-class of blends wherein the components are immiscible but have been compatibilized. "Miscibility" and "immiscibility" are defined as blends having negative and positive values, respectively, for the free energy of mixing. Further, "compatibilization" is defined as the process of modifying the interfacial properties of an immiscible polymer blend in order to make an alloy.

As used herein, the term "heteroconstituent nonwoven web" (or web layer) refers to a nonwoven web or layer having a mixture of at least two filament or fiber types A and B which differ from each other in terms of polymer contents, fiber size ranges, fiber shapes, pigment or additive loadings, crimp levels, and/or other compositional and physical properties.

As used herein, the term "multilayered nonwoven web" refers to a nonwoven web having at least two filament or fiber types arranged in two or more different layers. The filaments or fibers in the different layers may differ from each other in terms of overall polymer contents, fiber size ranges, fiber shapes, pigment or additive loadings, crimp levels, and/or other compositional and physical properties. The individual layers in a multilayered nonwoven web may, but need not be, heteroconstituent nonwoven web layers as described above.

DETAILED DESCRIPTION OF THE PRESENTLY PREFERRED EMBODIMENTS

In accordance with a first embodiment of the invention, a dual or split spinpack spinning process can be used to produce a heteroconstituent nonwoven web. Referring to FIG. 1, spinpacks 10A and 10B, which may be but are not necessarily identical, are separated by a duct 12. The spinpack 10A is used to extrude nonwoven polymer fibers or filaments, for example spunbond filaments, of a first type A. The spinpack 10B is used to extrude nonwoven polymer fibers or filaments, for example spunbond filaments, of a second type B.

The type A and type B filaments differ from each other in composition and/or physical properties. For instance, the type A and type B filaments may differ in polymer composition. Type A filaments may include polypropylene, and type B filaments may include polyethylene. Other polymers suitable for use in type A or type B filaments include without limitation, polyamides, polyesters, copolymers of ethylene and propylene, copolymers of ethylene or propylene with a $C_4$–$C_{20}$ alpha-olefin, terpolymers of ethylene with propylene and a $C_4$–$C_{20}$ alpha olefin, ethylene vinyl acetate copolymers, propylene vinyl acetate copolymers, styrene-poly(ethylene-alpha-olefin elastomers, polyurethanes, A-B block copolymers where A is formed of poly(vinyl arene) moieties such as polystyrene and B is an elastomeric mid-block such as a conjugated diene or lower alkene, polyethers, polyether esters, polyacrylates, ethylene alkyl acrylates, polyisobutylene, polybutadiene, isobutylene-isoprene copolymers and combinations of any of the foregoing.

The type A and type B filaments may also be different varieties of bicomponent filaments, or monocomponent and bicomponent filaments. The type A and type B may also have the same or different composition but different physical properties. For instance, the type A and type B filaments may have different mean fiber sizes, different fiber shapes, different levels of crimping, and/or different additive loadings.

Different varieties of bicomponent filaments include those polymeric filaments having at least two distinct components, commonly known in the art as "sheath-core" filaments, "side-by-side" filaments, and "island-in-the-sea" filaments. Filaments containing three or more distinct polymer components are also included. Such filaments are generally spunbond, but can be formed using other processes. Monocomponent filaments, by comparison, include only one polymer. The type A and type B filaments may be spunbond filaments that differ as to their compositions.

Spunbond filaments are substantially continuous and generally have average fiber diameters of about 12–55 microns, frequently about 15–25 microns. The type A and type B filaments may be spunbond filaments that differ as to their average fiber diameters.

Meltblown microfibers are generally discontinuous and have average fiber diameters of up to about 10 microns, preferably about 2–6 microns. The type A and type B filaments may be meltblown microfibers having different polymer compositions, different average fiber diameters, and/or different average lengths.

Nonwoven filaments may be crimped or uncrimped. Crimped filaments are described, for instance, in U.S. Pat. No. 3,341,394, issued to Kinney. Crimped filaments may have less than 30 crimps per inch, or between 30–100 crimps per inch, or more than 100 crimps per inch, for example. The type A and type B filaments may differ as to their levels of crimping, or as to whether crimping is present.

It is also possible to have other materials blended with the polymer used to produce a nonwoven according to this invention like fluorocarbon chemicals to enhance chemical repellency which may be, for example, any of those taught in U.S. Pat. No. 5,178,931, fire retardants for increased resistance to fire and/or pigments to give each layer the same or distinct colors. Fire retardants and pigments for spunbond and meltblown themoplastic polymers are known in the art and are frequently internal additives. A pigment, if used, is generally present in an amount less than 5 weight percent of the layer while other materials may be present in a cumulative amount less than 25 weight percent. The type A and type B filaments may differ as to their additive loadings, or as to whether or not a particular additive is present.

Referring to FIG. 1, one embodiment of the invention will be described. As shown, spinpacks 10A and 10B, which may be but are not necessarily identical, are separated by duct 12. Spinpacks 10A and 10B may be fed the polymers used to make filament types A and B. Depending on the process conditions, the filaments of different types may be mixed in the product or a layered structure may be obtained with the properties of the respective layers varying depending on the polymer and/or additives used in each. Fiber bundles 14, 16 are extruded from the spinpacks into quench zone 18. Advantageously, the fiber bundles are extruded from the bottom surface 20 of spinpacks 10A and 10B at an angle, $\alpha$, with the vertical or relative to the centerline of the central conduit to assist in directing the hot exhaust fluid (air) which has passed through the fiber bundles 14, 16 upward to the duct 12. This angle may be, for example, within the range of from a slight angle of about 1° to about 15° and especially within the range of from about 1° to about 5°. Likewise, sides 22, 24 of the quench zone advantageously are formed to direct air at a slight angle of about 1° to about 10° from the horizontal, to maintain a relative constant distance between the quench air and the fiber bundle for more uniform quench. Quench air is admitted laterally of the fiber bundles from both sides from ducts 26, 28 in opposing directions parallel to or nearly parallel to the spinplate although the flow pattern is shown only on one side for clarity. As shown, a portion of the quench air is exhausted upward through duct 12 while the rest is drawn to the fiber draw unit along with the fiber bundles. The temperature of the quench air is controlled to obtain the desired fiber properties. For example, for polypropylene spunbond web formation, quench air is advantageously in the range of from about 5° C. to about 25° C. As shown, the arrangement of the invention provides the advantages of multibank production in a single configuration and allows use of a single central fluid flow for both bundles. If desired, a fan assist may be provided to help remove fume laden air through the top. Also, depending on the need for increased flow stability, it may be desirable to provide an equalization slot between the spinplate surface and the quench duct, for example, of a width of about 1 inch to about 3 inches.

As explained above, the process may be adjusted so that the filaments of type A and the filaments of type B, produced by spinpacks 10A and 10B, are either mixed together in a single layer or brought together as separate layers in the product. Mixing of the filaments may be accomplished using more rapid quench air flow rates and velocities from the sides 22 and 24, and/or greater angles $\alpha$, so that the type A and type B filaments are strongly urged toward each other. Post treatments such as hydraulic entangling or mechanical needling (both known to persons skilled in the art) may further mix the filaments. Conversely, the type A and type B filaments will appear in two layers in the product if lower air flow rates and velocities from the sides 22 and 24 are used, and/or if the angle $\alpha$ is small, so that there is minimal urging of the type A and type B filaments toward each other.

FIG. 1 also illustrates in schematic form an advantageous means to insure that residues such as condensed oil or wax flow away from the spunbond system which is of use in some applications of moderate hole densities. As shown, spinpacks 10 are separated by duct 12 which is connected to duct 30 that is oriented at a downward angle to draw any condensates. Either or both ducts 12 and 30 may be insulated so as to minimize heat loss in the spinpacks. This duct may be rectangular exiting the spunbond machine and reformed to a circle or the like at collar 32. Duct 30 leads to condenser 34 which may be cooled by cooling water or the like through pipes 36, 38. The dewaxed air is then withdrawn such as by a fan through conduit 39. If needed, means conventionally used for such purposes may be used to draw the condensates (waxes) away from the spunbond system and through the condenser. For very high hole densities, other means for fume exhaust may be needed.

Figure 2:
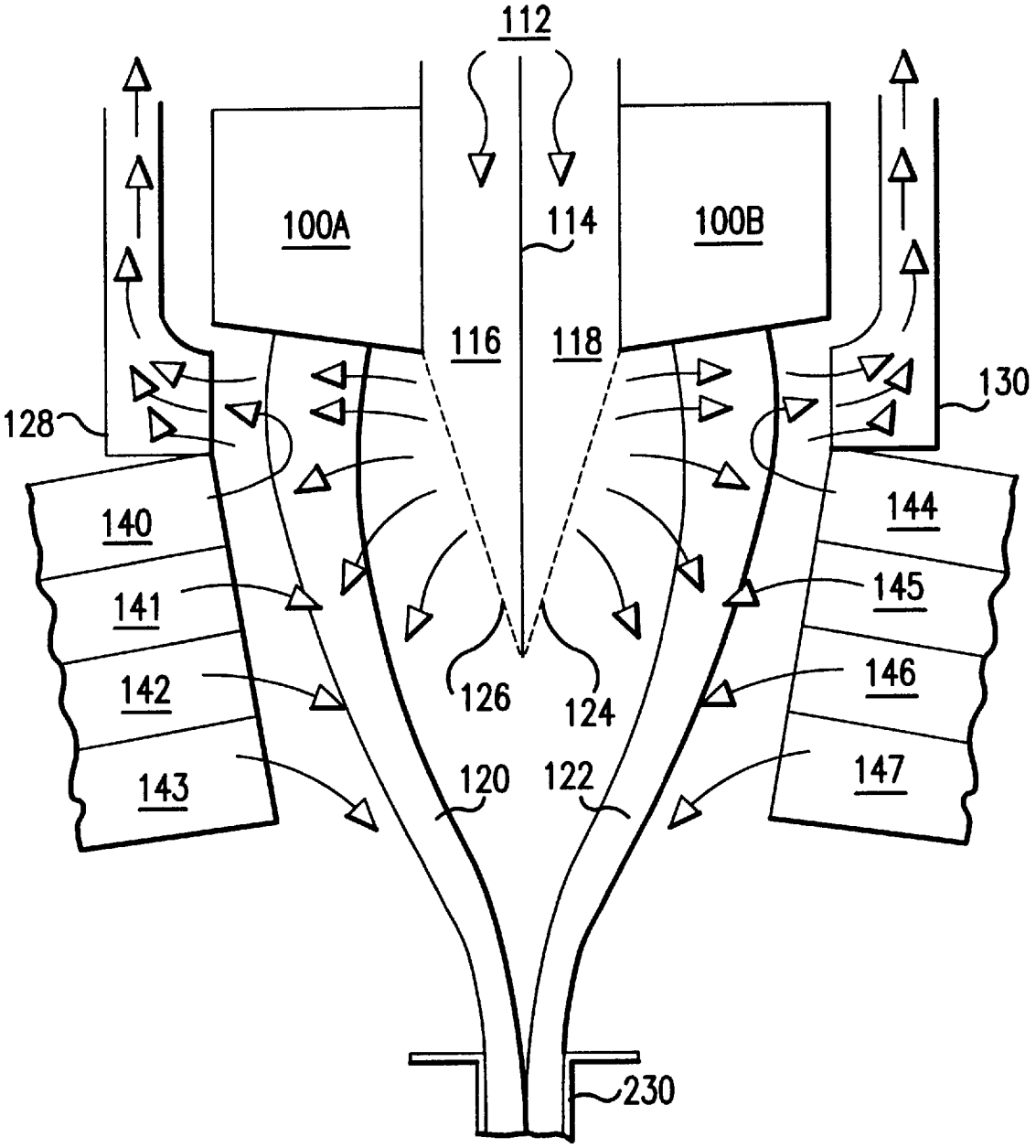
FIG. 2 is a schematic illustration of a different embodiment of a multiple spinplate arrangement and process of the present invention showing a central conduit used for two zone quench air supply.

FIG. 2 is a similar representation of a second embodiment where the quench air is brought into the middle (between the fiber bundles 120 and 122) and exhaust flows outward through the sides. As shown, spinpacks 100A and 100B are arranged on opposite sides of conduit or duct 112. Quench air may be supplied downward between the spinplates 100 in a single stream (or zone), pressurizing the airspace between the filament bundles 120, 122 so as to allow air to be drawn outward though each filament bundle. In this embodiment, duct 112 may advantageously be divided by divider 114 into supply zones 116, 118 which directs quench fluid through bundles 120, 122 respectively. At very high hole densities and high central air flow, any interaction of the flow from the sides is minimized. Perforated plates or screens 124, 126 may be provided to control the fluid flow and increase its uniformity. If used, these plates may advantageously have a graduated open area to further control the fluid flow. In this embodiment, fume exhaust ducts 128, 130 are disposed on the opposite sides of bundles 120, 122 to receive a portion of the quench fluid. The rest of the quench fluid is drawn toward filament bundles and carries or is carried by them toward the fiber draw zone (not shown) in much the same manner as in FIG. 1. This arrangement provides the advantages of the arrangement of FIG. 1 and, in addition, may permit control of quench fluid applied to the separate bundles. An added advantage is that any smoke may be kept warm until it reaches a desired location to deposit oils.

Because the embodiment of FIG. 2 uses substantial outward flowing quench air originating from ducts 116 and 118, this embodiment is more suitable for producing a layered product (with type A and type B filaments in separate layers) than a single-layer mixed product. Of course, the layers can subsequently be mixed by hydraulic entangling, mechanical needling, or other suitable techniques.

Figure 3:
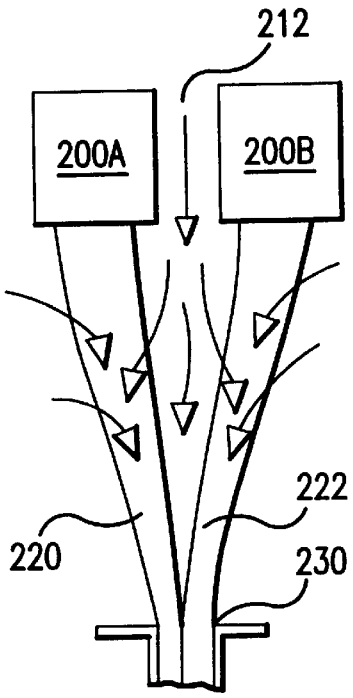
FIG. 3 is a schematic side view of a further embodiment of the type shown in FIG. 2 illustrating operation in the aspirating mode.
Figure 4:
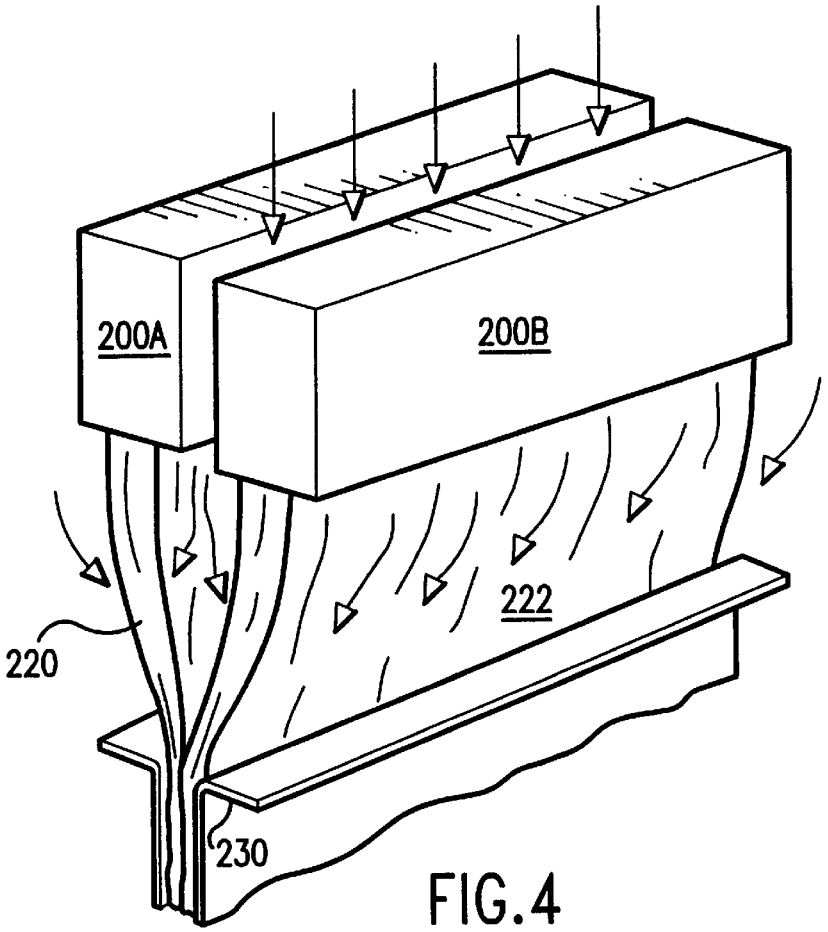
FIG. 4 is a perspective view of the type of embodiment shown in FIG. 3.
Figure 5:
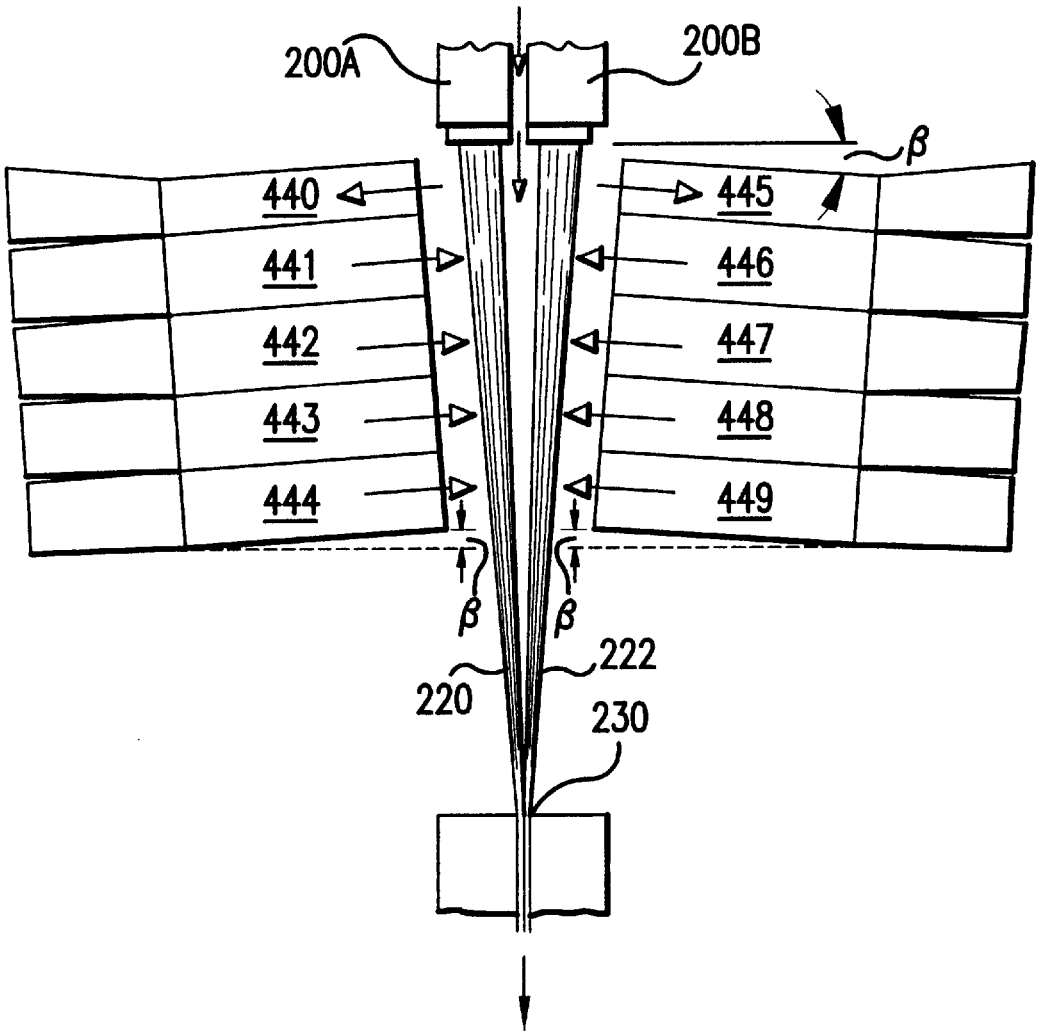
FIG. 5 is a view of an arrangement like that of FIG. 4 except that there are zones of quench air supply and the quench air is provided at a small angle to a line orthogonal to the central conduit.

FIG. 3 illustrates an embodiment operating in an aspirating mode where the vertical air stream drawn through conduit 212 aspirates quench air from the surroundings through the fiber bundles 220 (type A) and 222 (type B) from spinpacks 200A and 200B, to draw unit entry 230. In this arrangement, increased holes per inch of die width have been demonstrated as well as higher throughput and better spinline stability. For example, spinning of at least 320 holes per inch is possible with reduced quench air requirements and reduced process control equipment requirements. Other variations will be apparent such as using a divided draw unit to maintain separation of the curtains to lay them down in a layered construction of the same or different fibers. FIG. 4 is a perspective view of the arrangement of FIG. 3. FIG. 5 shows an embodiment with quench air zones 440–447 and a spin pack orientation at an angle "b" to horizontal or otherwise with respect to a line drawn orthogonally to the centerline of the central conduit. This angle may be within the range of from a slight angle of about 1° to about 15°, for example, and especially between about 1° and about 5° and may be obtained by, for example, by pivoting the spinplate or by shaping the spinplate surface. While the spacing between spinblocks may be varied, it is contemplated that most operations will be with a spacing in the range of from a slight spacing of less than about an inch to about 20 inches and especially within the range of from less than about an inch to about 1.5 inches. Other parameters of the arrangement will be generally within conventional ranges depending on the overall equipment configuration and desired operating conditions. For example, vertical quench air flow of from about 100 ft./min to about 1000 ft./min, for example, provides sufficient aspiration for a desirable level of heat transfer.

In embodiments such as shown in FIGS. 3–5, the flow rate of the central downward-flowing quench air stream versus the flow rates of the lateral inward-flowing quench air streams will affect whether the product has separate layers of type A and type B filaments or whether the filaments are mixed. If the central downward-flowing air stream has sufficient velocity and force to maintain separation between the fiber bundles 220 and 222, overcoming the competing forces exerted by the lateral inward-flowing streams, then the product will have two layers representing type A and type B filaments. If the lateral inward-flowing air streams have sufficient velocity and force to overcome the central downward-flowing stream, the type A and type B filaments may be mixed to varying degrees.

Figure 6:
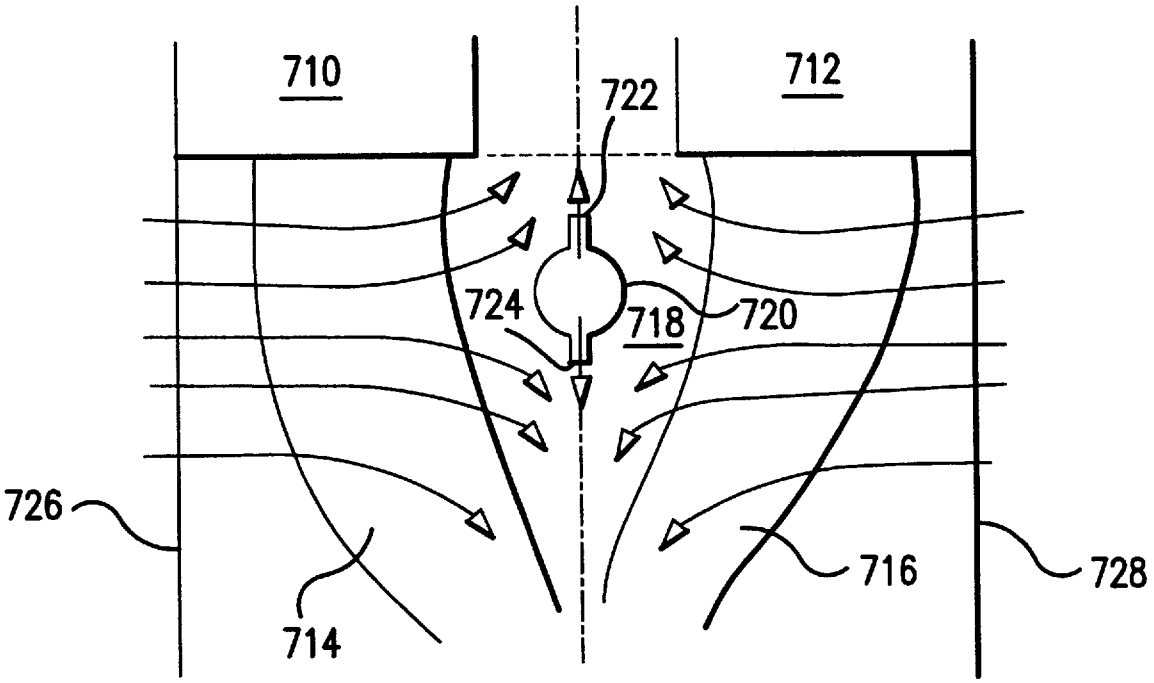
FIG. 6 is an illustration in schematic of an arrangement which can be used with multiple spinplates or with a single spinplate having a portion blocked off where no fibers are formed. Quenching air is caused to flow in opposite directions along the center line of a central conduit.

FIG. 6 illustrates in schematic form an arrangement which can be used with multiple spinplates or with a single spinplate having a portion blocked off where no fibers are formed. Spinplate areas 710, 712 issue filament bundles 714, 716 separated by central conduit 718. Nozzle 720 connected to a quench fluid source directs quench upward and/or downward through apertures 722, 724. Quench air can be aspirated and/or blown in from sides 726, 728 through bundles 714, 716 as indicated. In this manner, a particularly economic system can be achieved by modification of an existing spinplate. Also, the relative flow in either direction may be easily controlled by selection of design parameters of the nozzle 720 and apertures 722, 724.

Figure 7:
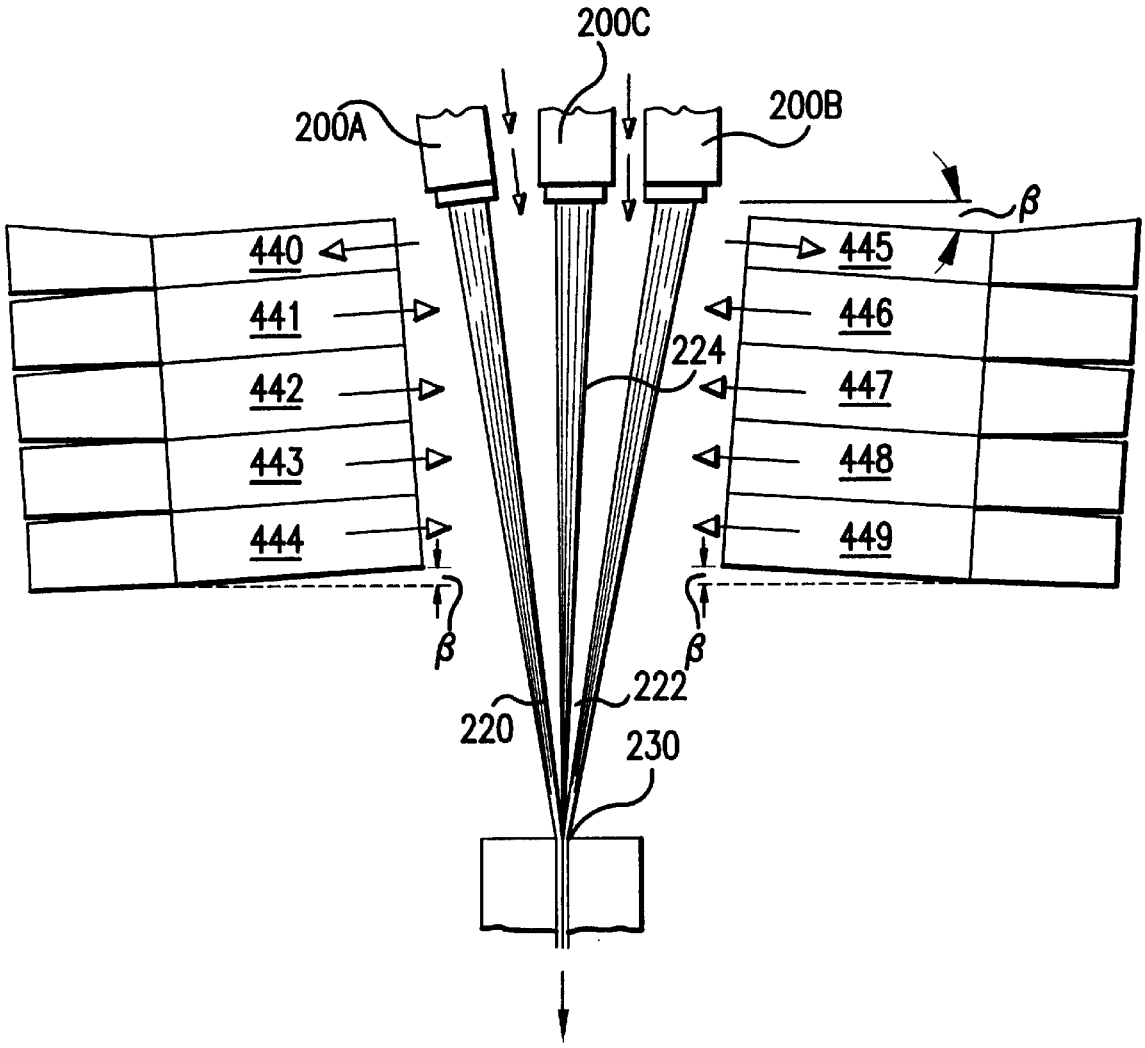
FIG. 7 illustrates a bank system which can be used to make a three-layer spunbond structure.

FIG. 7 illustrates how three spinpacks 200A, 200B and 200C can be combined to produce a three-layer nonwoven structure. The embodiment of FIG. 7 resembles that of FIG. 5 except that a third spinpack 200C is inserted between the spinpacks 200A and 200B. Spinpacks 200A, 200B and 200C produce three fiber bundles 220, 222 and 224 which can be type A, B and C filaments or any combination. For instance, the fiber bundles 220, 222 and 224 can include filaments of type A/type B/type C, type A/type B/type A, type A/type A/type B, type A/type B/type B, type B/type C/type A, type A/type C/type B, and other combinations. In the embodiment of FIG. 7, two vertical quench air streams are needed to quench and maintain separation between fiber bundles 220 and 224, and between fiber bundles 222 and 224. The process may be performed using two groups of lateral air quench zones (e.g., 440–444 and 445–449) as is the case with the two spinpack system of FIG. 5. After quenching, the fiber bundles 220, 222 and 224 are merged together in the form of layers using the draw unit 230.

The three-spinpack system of FIG. 7 can be used to produce three-layer nonwoven structures with a variety of advantages. For instance, a less expensive polymer can be used as a center "filler" layer while one or two more expensive polymers exhibiting improved softness are used in the outside layers, thereby lowering overall cost. Also, one of the outside layers may be tailored for improved bonding to a film or other substrate. Also, the three-layer capability permits manufacture of numerous structures having different layer ratios, different filament shapes and sizes, different polymer compositions, different crimp levels, and different pigment or additive loadings.

While the embodiments disclosed herein are presently preferred, various modifications and improvements can be made without departing from the spirit and scope of the invention. The scope of the invention is indicated by the appended claims, and all changes that fall within the meaning and range of equivalency are intended to be embraced therein.

We claim:

1. A method of making a heteroconstituent nonwoven material including a mixture of polymer filaments of a first type A and filaments of a second type B, comprising the steps of:

extruding filaments of the first type A from a first spinpack;

extruding filaments of the second type B from a second spinpack;

quenching the filaments of the first type A and second type B by supplying a first air stream laterally of the type A filaments and a second opposing air stream laterally of the type B filaments;

the first and second opposing air streams having sufficient velocities and flow rates to bring the type A and type B filaments together and cause at least some mixing of the type A and type B filaments resulting in a heteroconstituent nonwoven material;

wherein the first air stream and second air stream are supplied at about 5°–25° C.

2. The method of claim 1, further comprising the step of supplying a third air stream from in between the type A and type B filaments before they are brought together.

3. The method of claim 2, wherein the third air stream is supplied at about 5°–25° C.

4. The method of claim 1, wherein the type A and type B filaments are extruded toward each other at angles of about 1–15 degrees from the vertical.

5. The method of claim 1, wherein the type A and type B filaments are extruded toward each other at angles of about 1–5 degrees from the vertical.

6. The method of claim 1, wherein the first and second air streams are directed toward each other at angles of about 1–10 degrees from the horizontal.

7. The method of claim 2, further comprising the step of supplying a fourth air stream from in between the type A and type B filaments before they are brought together.

8. The method of claim 1, wherein the type A filaments and type B filaments have different compositions.

9. The method of claim 1, wherein the type A filaments and type B filaments comprise different polymer compositions.

10. The method of claim 9, wherein the type A filaments and type B filaments comprise polymers selected from the group consisting of polyamides, polyesters, copolymers of ethylene and propylene, copolymers of ethylene or propylene with a $C_4$–$C_{20}$ alpha-olefin, terpolymers of ethylene with propylene and a $C_4$–$C_{20}$ alpha olefin, ethylene vinyl acetate copolymers, propylene vinyl acetate copolymers, styrene-poly(ethylene-alpha-olefin)elastomers, polyurethanes, A-B block copolymers where A is formed of poly(vinyl arene) moieties such as polystyrene and B is an elastomeric midblock such as a conjugated diene or lower alkene, polyethers, polyether esters, polyacrylates, ethylene alkyl acrylates, polyisobutylene, polybutadiene, isobutylene-isoprene copolymers and combinations of any of the foregoing.

11. The method of claim 9, wherein at least one of the type A filaments and type B filaments comprises bicomponent filaments.

12. The method of claim 11, wherein the type A filaments and type B filaments comprise bicomponent filaments having different compositions.

13. The method of claim 11, wherein the type A filaments and type B filaments comprise bicomponent filaments having different configurations.

14. The method of claim 1, wherein the type A and type B filaments comprise different additive loadings.

15. The method of claim 1, wherein the type A filaments and type B filaments comprise spunbond filaments.

16. The method of claim 1, wherein the type A filaments and type B filaments have different levels of crimping.

17. The method of claim 16, wherein one of the filament types is uncrimped and the other of the filament types is crimped.

18. The method of claim 16, wherein both filament types are crimped.

19. The method of claim 16, wherein the type A filaments and type B filaments comprise spunbond filaments.

20. The method of claim 1, wherein the type A filaments and type B filaments have different average filament sizes.

21. The method of claim 20, wherein the type A filaments and type B filaments have different average fiber diameters.

22. The method of claim 20, wherein the type A filaments and type B filaments have different average fiber lengths.

23. The method of claim 20, wherein the type A filaments and type B filaments comprise spunbond filaments.

24. A method of making a multilayered nonwoven material including a layer of polymer filaments of a first type A and a layer of filaments of a second type B, comprising the steps of:

extruding filaments of the first type A from a first spinpack;

extruding filaments of the second type B from a second spinpack;

quenching the filaments of the first type A and second type B by supplying a first air stream laterally of the type A filaments and a second opposing air stream laterally of the type B filaments;

the first and second opposing air streams having sufficient velocities and flow rates to bring the type A and type B filaments together in the form of layers resulting in a multilayered nonwoven material.

25. The method of claim 24, further comprising the step of supplying a third air stream from in between the type A and type B filaments before they are brought together.

26. The method of claim 24, wherein the first air stream and second air stream are supplied at about 5°–25° C.

27. The method of claim 24, wherein the third air stream is supplied at about 5°–25° C.

28. The method of claim 24, wherein the type A and type B filaments are extruded toward each other at angles of about 1–15 degrees from the vertical.

29. The method of claim 24, wherein the type A and type B filaments are extruded toward each other at angles of about 1–5 degrees from the vertical.

30. The method of claim 24, wherein the first and second air streams are directed toward each other at angles of about 1–10 degrees from the horizontal.

31. The method of claim 25, further comprising the step of supplying a fourth air stream in between the type A and type B filaments before they are brought together.

32. A method of making a multilayered nonwoven material including at least three nonwoven layers, comprising the steps of:

extruding a first bundle of filaments from a first spinpack;

extruding a second bundle of filaments from a second spinpack;

extruding a third bundle of filaments from a third spinpack located between the first and second spinpacks;

supplying a first quench air stream laterally of the first bundle of filaments and a second opposing quench air stream laterally of the second bundle of filaments;

supplying a third quench air stream between the first and third bundles of filaments;

supplying a fourth quench air stream between the second and third bundles of filaments; and merging the first, second and third bundles of filaments together in the form of layers resulting in a multilayered nonwoven material.

33. The method of claim 32, wherein the first bundle comprises filaments of a first type A and at least one of the second and third bundles comprises filaments of a second type B.

34. The method of claim 33, wherein the second bundle comprises filaments of the first type A, and the third bundle comprises filaments of the second type B.

35. The method of claim 33, wherein the second bundle comprises filaments of the second type B, and the third bundle comprises filaments of the first type A.

36. The method of claim 33, wherein the other of the second and third bundles comprises filaments of a third type C.

37. A method of making a heteroconstituent nonwoven material including a mixture of polymer filaments of a first type A and filaments of a second type B, comprising the steps of:

extruding filaments of the first type A from a first spinpack;

extruding filaments of the second type B from a second spinpack;

quenching the filaments of the first type A and second type B by supplying a first air stream laterally of the type A filaments and a second opposing air stream laterally of the type B filaments;

the first and second opposing air streams having sufficient velocities and flow rates to bring the type A and type B filaments together and cause at least some mixing of the type A and type B filaments resulting in a heteroconstituent nonwoven material;

wherein the type A and type B filaments are extruded toward each other at angles of about 1–15 degrees from the vertical.

38. The method of claim 37, further comprising the step of supplying a third air stream from in between the type A and type B filaments before they are brought together.

39. The method of claim 37, wherein the type A and type B filaments are extruded toward each other at angles of about 1–5 degrees from the vertical.

40. The method of claim 37, wherein the first and second air streams are directed toward each other at angles of about 1–10 degrees from the horizontal.

41. The method of claim 38, further comprising the step of supplying a fourth air stream from in between the type A and type B filaments before they are brought together.

42. The method of claim 37, wherein the type A filaments and type B filaments have different compositions.

43. The method of claim 37, wherein the type A filaments and type B filaments comprise different polymer compositions.

44. The method of claim 38, wherein the type A and type B filaments comprise different additive loadings.

45. The method of claim 37, wherein the type A filaments and type B filaments comprise spunbond filaments.

46. A method of making a heteroconstituent nonwoven material including a mixture of polymer filaments of a first type A and filaments of a second type B, comprising the steps of:

extruding filaments of the first type A from a first spinpack;

extruding filaments of the second type B from a second spinpack;

quenching the filaments of the first type A and second type B by supplying a first air stream laterally of the type A filaments and a second opposing air stream laterally of the type B filaments;

the first and second opposing air streams having sufficient velocities and flow rates to bring the type A and type B filaments together and cause at least some mixing of the type A and type B filaments resulting in a heteroconstituent nonwoven material;

wherein at least one of the type A filaments and type B filaments comprises bicomponent filaments.

47. The method of claim 46, wherein the type A filaments and type B filaments comprise bicomponent filaments having different compositions.

48. The method of claim 46, wherein the type A filaments and type B filaments comprise bicomponent filaments having different configurations.

49. The method of claim 46, wherein the type A filaments and type B filaments comprise spunbond filaments.

50. A method of making a heteroconstituent nonwoven material including a mixture of polymer filaments of a first type A and filaments of a second type B, comprising the steps of:

extruding filaments of the first type A from a first spinpack;

extruding filaments of the second type B from a second spinpack;

quenching the filaments of the first type A and second type B by supplying a first air stream laterally of the type A filaments and a second opposing air stream laterally of the type B filaments;

the first and second opposing air streams having sufficient velocities and flow rates to bring the type A and type B filaments together and cause at least some mixing of the type A and type B filaments resulting in a heteroconstituent nonwoven material;

wherein the type A filaments and type B filaments have different levels of crimping.

51. The method of claim 50, wherein one of the filament types is uncrimped and the other of the filament types is crimped.

52. The method of claim 50, wherein both filament types are crimped.

53. The method of claim 50, wherein the type A filaments and type B filaments comprise spunbond filaments.

54. A method of making a heteroconstituent nonwoven material including a mixture of polymer filaments of a first type A and filaments of a second type B, comprising the steps of:

extruding filaments of the first type A from a first spinpack;

extruding filaments of the second type B from a second spinpack;

quenching the filaments of the first type A and second type B by supplying a first air stream laterally of the type A filaments and a second opposing air stream laterally of the type B filaments;

the first and second opposing air streams having sufficient velocities and flow rates to bring the type A and type B filaments together and cause at least some mixing of the type A and type B filaments resulting in a heteroconstituent nonwoven material;

wherein the type A filaments and type B filaments have different average filament sizes.

55. The method of claim 54, wherein the type A filaments and type B filaments have different average fiber diameters.

56. The method of claim 54, wherein the type A filaments and type B filaments have different average fiber lengths.

57. The method of claim 54, wherein the type A filaments and type B filaments comprise spunbond filaments.

* * * * *